US007549431B1

(12) United States Patent
Farnworth et al.

(10) Patent No.: US 7,549,431 B1
(45) Date of Patent: Jun. 23, 2009

(54) PROTECTIVE ENCLOSURE

(75) Inventors: Brian Farnworth, Elkton, MD (US); Edward C. Gunzel, Oxford, PA (US); Gregory D. Culler, Nottingham, PA (US)

(73) Assignee: Gore Enterprise Holdings, Inc., Newark, DE (US)

( * ) Notice: Subject to any disclaimer, the term of this patent is extended or adjusted under 35 U.S.C. 154(b) by 448 days.

(21) Appl. No.: 10/985,420

(22) Filed: Nov. 10, 2004

(51) Int. Cl.
*E04H 15/54* (2006.01)
*A62B 17/00* (2006.01)

(52) U.S. Cl. ..... 135/115; 135/137; 135/93; 2/457; 2/84; 428/196; 5/417 R

(58) Field of Classification Search ..... 135/87, 135/115, 119, 96, 137, 93; 52/1; 428/196, 428/76; 2/84, 87, 89, 457, 202; 5/413 R
See application file for complete search history.

(56) References Cited

U.S. PATENT DOCUMENTS

| | | | | |
|---|---|---|---|---|
| 3,586,596 | A | 6/1971 | Ainsworth et al. | 161/87 |
| 3,953,566 | A | 4/1976 | Gore | 264/288 |
| 4,153,193 | A | 5/1979 | Urbanowicz | 227/156 |
| 4,510,193 | A | 4/1985 | Blucher et al. | 428/196 |
| 4,612,237 | A | 9/1986 | Frankenburg | 428/219 |
| 4,932,078 | A | 6/1990 | Jones et al. | 2/70 |
| 5,082,471 | A | 1/1992 | Athayde et al. | 55/16 |
| 5,401,901 | A * | 3/1995 | Gerry et al. | 174/391 |
| 5,981,019 | A | 11/1999 | Goodwin et al. | 428/76 |
| 6,074,738 | A | 6/2000 | von Fragstein et al. | 428/315.9 |
| 6,261,678 | B1 | 7/2001 | von Fragstein et al. | 428/315.9 |
| 6,497,934 | B1 * | 12/2002 | Mahn et al. | 428/57 |
| 6,508,850 | B1 * | 1/2003 | Kotliar | 55/385.2 |
| 6,691,314 | B1 * | 2/2004 | Grilliot et al. | 2/5 |
| 6,691,326 | B2 * | 2/2004 | Hexels | 2/457 |
| 6,792,625 | B2 * | 9/2004 | Hexels | 2/457 |
| 7,216,657 | B2 * | 5/2007 | Choi | 135/93 |
| 2002/0083653 | A1 * | 7/2002 | Hilbert | 52/2.17 |
| 2003/0135916 | A1 * | 7/2003 | Hexels | 2/457 |
| 2004/0009726 | A1 | 1/2004 | Axtell et al. | 442/123 |
| 2004/0074529 | A1 | 4/2004 | Levy et al. | 135/93 |
| 2005/0266228 | A1 * | 12/2005 | Jain et al. | 428/316.6 |

FOREIGN PATENT DOCUMENTS

| | | | |
|---|---|---|---|
| DE | 19708999 | A1 * | 10/1998 |
| GB | 2 096 536 | A | 10/1982 |
| JP | 10335879 | A * | 12/1998 |
| WO | WO 2004/037349 | | 5/2004 |

* cited by examiner

*Primary Examiner*—Winnie Yip
(74) *Attorney, Agent, or Firm*—Dianne Burkhard

(57) ABSTRACT

The present invention describes chemical protective enclosure comprising a waterproof outer surface comprising an impermeable portion and an air diffusive portion, and further comprising a chemically adsorptive material substantially adjacent the air diffusive portion, wherein there is sufficient diffusion of breathable air into the chemical protective enclosure to sustain life.

31 Claims, 6 Drawing Sheets

PROTECTIVE ENCLOSURE

FIELD OF THE INVENTION

The present invention relates to a chemical protective enclosure that is impermeable to liquids while having sufficient air permeability to sustain life.

BACKGROUND OF THE INVENTION

Various masks, coverings, garments and shelters are known for providing protection against contaminants, such as hazardous chemical and biological agents. Gas masks provide some protection by filtration means, however, the benefits of a mask are limited, among other things, by difficulty in obtaining proper fit and lack of skin protection. Chemically resistant materials are known for use in protective garments and the like to provide protection from direct skin contact. For example, air permeable protective garments made of adsorbent filter material affixed to air permeable textile supports are disclosed in U.S. Pat. Nos. 4,510,193, and 4,153,745. Materials permeable to both water vapor and air advantageously provide enhanced wearer comfort, and such garments may be used in combination with gas masks to achieve both respiratory and skin protection. Disadvantageously, adsorbent filter layers used in garments are often heavy and bulky while not providing complete protection, and gas mask filter cartridges have limited life requiring replacement when filtration capacity has been expended.

Numerous fluid impermeable casualty bag and shelter designs have been developed in an effort to maintain separation between safe and hazardous environments. Certain impermeable shelters may provide overall protection against liquid and gaseous challenges to one or more persons. However, such systems are also heavy and bulky, and rely on detoxified air from external air supply systems which require a power source. For example, U.S. Pub. No. 2004/0074529 teaches a self-contained and ventilated temporary shelter that includes first and second temporary living spaces made of a hermetically sealed casing, and an air purification system. The air purification system provides a source of filtered air to the shelter, and includes a filtration media to filter out chemical agents, a hepa filter for microscopic organisms, and a UV germicidal filtration unit to filter out pathogens. The air filtration system is powered by AC/DC or an alternate power source.

WO 2004/037349 teaches a protective bag for enclosing at least one human body, made of a multilayered plastic impermeable to hazardous chemicals. To improve the impermeable nature of the bag, an air compressor unit or other means for maintaining a positive air pressure within the bag is optionally included, and a pressure-activated one way valve is adapted to permit excess air pressure to exit the bag. An external air source, such as an oxygen tank or mechanized air filter capable of extracting purified air from a contaminated environment and injecting it into the bag, may be used. A gas mask protects against inhalation of lethal gases, and enables easier breathing through non-mechanized filters by increasing suction forces on the filters. As noted above, filters have limited life and must be replaced when filtration capacity has been expended.

For increased protection and to extend useful life of protective filters, excess adsorbent, such as activated charcoal is often added to the system creating additional weight and bulk. Methods of extending the life of the filter to avoid the expense and the logistical burden of replacement have been sought to solve this problem. U.S. Pat. No. 5,082,471 teaches a life support system for personnel shelter in which the levels of toxic agent to which the filter unit is exposed is reduced, thus extending filter life. The system comprises a shelter and equipment for sustaining a breathable atmosphere within the shelter. A supply of fresh air is fed to a membrane separation unit that is highly selective to the permeation of oxygen over toxic agents, producing an oxygen enriched permeate stream that passes through a unit containing a sorbent to remove remaining traces of toxic material before being fed into the shelter. Carbon dioxide is removed by either maintaining a high air flow into and out of the shelter, or by withdrawing air from the shelter, treating it in a separate unit of equipment, and returning the treated air to the shelter. The additional equipment required to provide air and remove carbon dioxide results in a system that is particularly heavy, large and bulky.

Disadvantageously, known enclosure systems which maintain a source of airflow, are often heavy and bulky due to the need for high filter agent adsorbent loadings. Moreover, enclosure systems that rely on external airflow systems to achieve levels of oxygen necessary to sustain life disadvantageously require a power source. What is desired is an air permeable protective enclosure system that provides high levels of protection against hazardous gaseous, vapor, or aerosol chemical and biological agents, without the need for heavy, bulky filtration units using minimum sorbent to reduce weight and increase flexibility. Moreover, it would be desirable for this protective enclosure system to be simultaneously capable of providing life-sustaining levels of oxygen within the system without relying on supplemental air supply sources.

SUMMARY OF THE INVENTION

In the present invention protective enclosures are provided that are sealed from chemical or biological hazardous threats while having sufficient air and carbon dioxide permeability to sustain the life of the occupants without the use of an auxilliary air source, such as the heavy, powered, bulky filtration units currently used to achieve high levels of protection. Surprisingly, no external air supply and no internal air purification units are needed to maintain a life-supporting internal atmosphere. Preferred protective enclosures of the present invention have a waterproof outer surface, where one portion of the enclosure's outer surface is a barrier section that is impermeable to liquids and gases, and another portion of the outer surface is air diffusive. The air diffusive portion restricts the passage of bulk air, thereby substantially inhibiting the ingress of toxic chemical agents, while permitting adequate diffusion of air into the protective enclosure to sustain life. A chemical protective material is provided adjacent to the air diffusive section to eliminate any remaining chemical or biological threat that may pass through the air diffusive section.

Protective enclosures of the present invention further provided protection against wind driven agent challenges. When transporting an injured person in a casualty bag into a transport helicopter, the rotor wash during a hover can range from 9 to 15 m/s for military aircraft which equates to air pressures between about 50 Pa to about 135 Pa. (Reference: Teske, M. E., et. al., *Field Measurements of Helicopter Rotor Wash in Hover and Forward Flight,* 2nd International Aeromechanics Specialists' Conference, American Helicopter Society, Bridgeport, Conn., 1995.) Thus, the preferred protective enclosure of the present invention blocks convective air flow at higher air pressures, and optimally reduces the ingress of chemical or biological agent challenges to a diffusive mechanism. Blocking convective airflow through the protective barrier increases the opportunity of a chemical assault to be reduced by evaporation or transmission away from the outside surface of the enclosure. Moreover, the ingress of any remaining chemical or biological agent by way of diffusion results in an increase in the residence time of the agent in the chemical protective material. By increasing the residence time of the penetrant as it begins to diffuse into the protective enclosure, a much thinner and lighter layer of the chemical protective material (16) is required to stop passage of agent through to the internal environment of the enclosure. Absent the novel diffusive characteristics of the protective enclosures of the present invention, much thicker layers of chemical protective material would be required to accommodate the shorter residence time of convectively flowing penetrants.

DETAILED DESCRIPTION OF THE INVENTION

Figure 1:
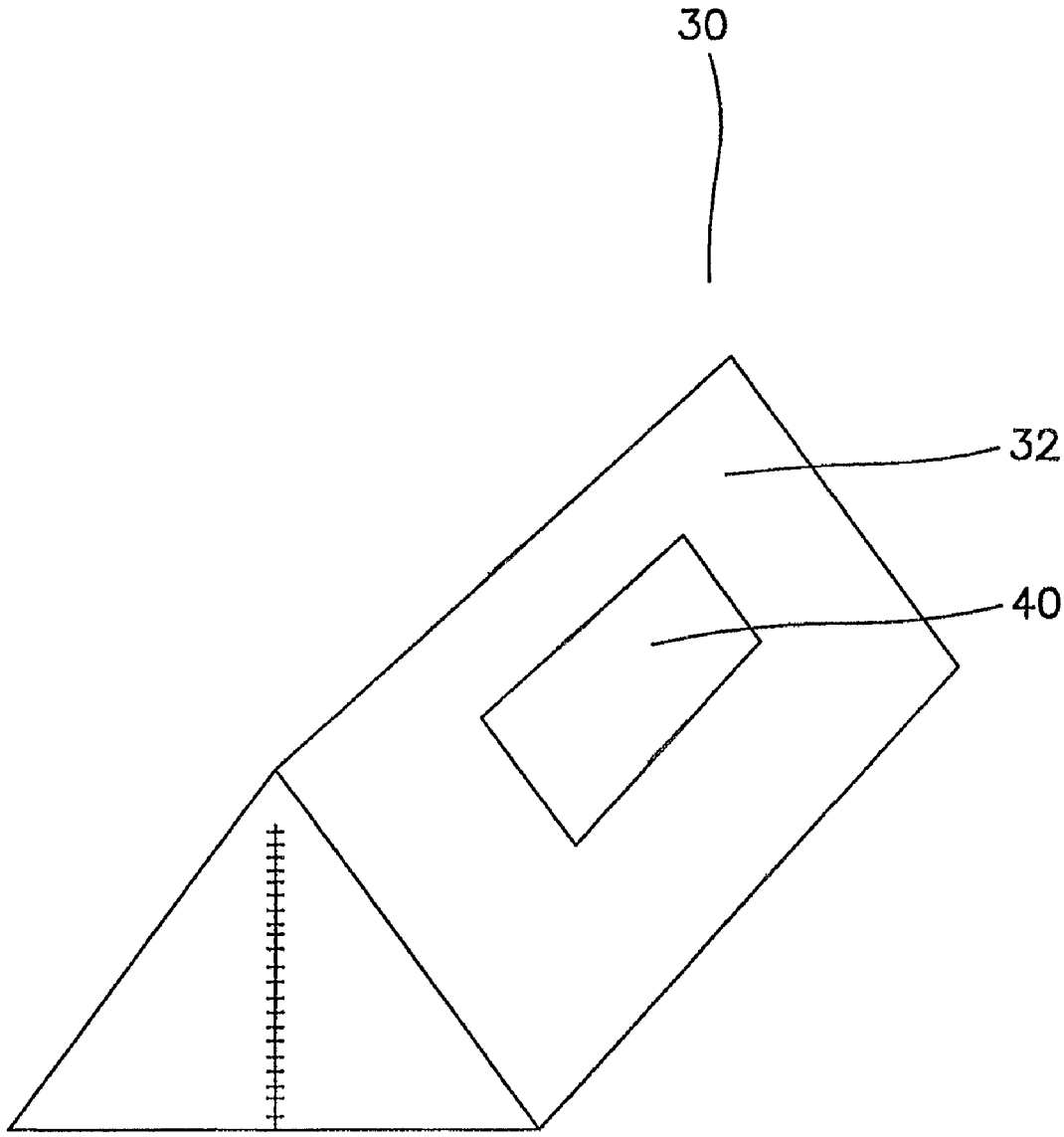
FIG. 1 depicts a perspective representation of a chemical protective enclosure in the form of a tent.

The present invention provides a protective enclosure that can be sealed from chemical or biological hazardous threats while having sufficient air and carbon dioxide permeability to sustain the life of the occupants. Surprisingly, this sealed enclosure requires no external air supply and no internal air purification units while maintaining a life-supporting internal atmosphere. Specifically, the protective enclosure comprises an outer surface comprising an impermeable barrier section and a diffusive protective section. In a preferred embodiment the present invention is directed to a protective enclosure comprising a waterproof outer surface comprising an impermeable barrier section and an air diffusive portion, and further comprises a chemically adsorptive material. Preferably the air diffusive portion comprising a microporous membrane, and the chemical protective material is adjacent to the microporous membrane.

The impermeable barrier section is impermeable to gas and liquids, and therefore restricts penetration of chemical and biological agents into the protective enclosure through this section. Materials suitable for use as the impermeable barrier section can be comprised of any impermeable barrier material capable of providing permeation resistance against the environmental challenges required for the specific end application. Optionally, enhanced protection of this barrier material can be provided by adding at least one woven, knit or nonwoven textile material to the impermeable barrier material. This barrier material and textile material can be provided as a composite wherein the impermeable barrier material may be laminated to the textile, coated onto the textile, imbibed into the textile, or otherwise affixed adjacent to the textile. The textile may include synthetic fibers, natural fibers, or blends of synthetic and natural fibers.

One suitable impermeable barrier section material useful for chemical and biological protective fabric construction is a composite including polytetrafluoroethylene film. Exemplary polytetrafluoroethylene-containing protective fabric constructions are available from W. L. Gore and Associates (Elkton, Md.) under part number ECAT 614001B. Such protective fabric constructions provide excellent chemical penetration and permeation resistance in addition to high thermal stability, both properties that are required for applications such as fire fighting and hazardous material handling. In addition, the impermeable nature of this type of protective fabric construction provides excellent biological protection, making it ideal for many types of emergency medical personnel. Alternatively, the impermeable barrier section material used in the chemical and biological protective fabric construction can be any suitable waterproof material capable of providing the necessary level of protection. For example, the fabric constructions known under the tradename Tychem® fabric (from DuPont) are acceptable for many conditions.

In one embodiment of particular interest, the impermeable barrier section may be provided as a laminate comprised of at least one textile material and at least one impermeable barrier material. Laminates may be produced by any method known in the art, for example, by printing an adhesive onto one layer in a discontinuous pattern, in an intersecting grid pattern, in the form of continuous lines of adhesive, or as a thin continuous layer, and then introducing the second layer in a way that the adhesive effectively joins and adheres together the two adjacent surfaces of impermeable barrier material and the textile material. The textile material preferably provides at least some abrasion resistance to help protect the impermeable barrier material. Alternatively, the textile and the impermeable barrier material can be detached from each other except at isolated discrete connection points such as around a perimeter of the article and/or at irregular, sporadic intervals.

An optional second textile material may be present on the inside of the impermeable barrier material or laminate, for example, to provide at least some abrasion resistance to the side of the impermeable barrier section material opposite the first textile material. And in the case of an apparel protective enclosure, such as a coverall or hood, a textile material can provide a more comfortable surface against the wearer. The second textile material may comprise a woven, knit, nonwoven textile, or any other flexible substrate comprising textile fibers including, but not limited to, flocked fibers. The inclusion of a second textile material creates what is often referred to as a "3 layer" laminate.

The air diffusive portion of this invention allows oxygen to diffuse into the protective enclosure at a rate sufficient to maintain enough oxygen in the protective enclosure to sustain the life of an occupant, while also facilitating the diffusion of carbon dioxide out of the enclosure so that high $CO_2$ levels do not accumulate within the protective enclosure. By the phrase "sufficient diffusion of oxygen to sustain the life of the occupants," it is meant that the air diffusive portion allows sufficient air into the enclosure to maintain oxygen in levels at greater than or equal to about 16%, thus replenishing oxygen consumed by the occupants over time. Equally important, while these gases are diffusing into and out from the protective enclosure, the ingress of hazardous gases, vapors, and liquids is prevented from entering the protective enclosure. Most surprisingly, a preferred enclosure of the present invention comprises an optimal combination of the impermeable barrier section and the diffusive protective panel to provide respiratory level protection against the ingress of hazardous chemicals in the presence of wind-driven airflow, while allowing the passage of air and carbon dioxide at levels capable of sustaining life without the need for gas masks and auxiliary air sources. The novel gas balancing and chemical penetration resistant characteristics of this protective enclosure constitute the basis of this invention.

Figure 3:
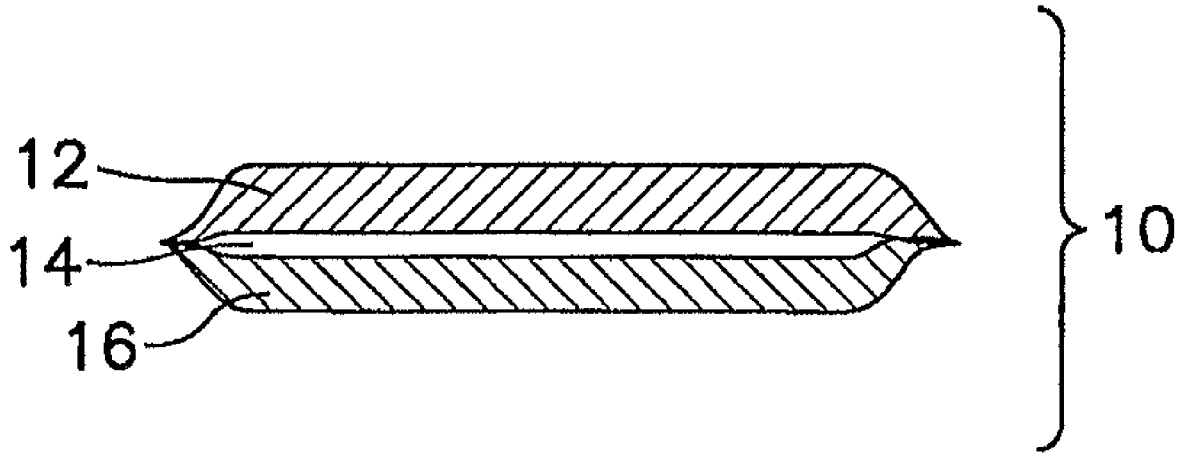
FIG. 3 is a cross-sectional representation of a diffusive protective panel.

One embodiment of the present invention is a chemical protective tent, for example, as depicted in FIG. 1 that comprises a gas and liquid impermeable chemical and biological barrier section 32 and an air diffusive portion section 40. FIG. 3 depicts one example of an air diffusive portion, wherein a microporous polymer layer (12) is positioned adjacent and substantially parallel to a chemical protective material (16). In one embodiment, the microporous polymer layer (12) and the chemical protective material are integrated to form a diffusive protective panel (10). The microporous polymer layer and the chemical protective material may be separated by an interfacial region (14) or they may be in contact with each other. In one embodiment, the microporous polymer layer (12) is a membrane of expanded polytetrafluoroethylene (PTFE) having a microstructure sufficiently tight so as to provide protection against wind-driven convective airflow. Expanded membranes of this type are taught in U.S. Pat. No. 3,953,566. To block convective airflow and reduce the ingress of chemical or biological agents, the air diffusive portion of the present invention, has an airflow at 100 Pascals of about less than 5 liter/square meter/second ($L/m^2/s$), further preferred less than 3 $L/m^2/s$ , and an airflow of about less than 2 $L/m^2/s$ is particularly preferred, when airflow is measured according to the test method described below.

In addition to restricting convective airflow, a preferred air diffusive portion can provide protection against liquid challenges. For example, a microporous polymer layer (12) comprising expanded PTFE may be inherently hydrophobic and thereby provide waterproofness. Depending on the level of protection needed, for example, if a dirtier environment is anticipated, the microporous polymer layer (12) can be comprised of an expanded PTFE membrane that has been treated with a fluoropolymer coating to enhance the oleophobicity of the membrane. Suitable oleophobic treatments are described in U.S. Pat. Nos. 6,074,738 and 6,261,678, which is hereby incorporated by reference. In an alternate embodiment, the microporous polymer layer (12) comprises a microporous polyurethane membrane having a microstructure sufficient to achieve the preferred airflows listed above thereby preventing wind-driven convective airflow and preventing penetration of hazardous liquid and mist-type challenges. Aerosol challenges may be solid or liquid particles that are composed entirely or partly of chemically or biologically harmful substances. If they have particle diameters of the order of a few microns, they may suspend in air for extended periods and readily penetrate materials with pores greater than a few microns as the air flows convectively through these materials. Thus, materials with pore sizes of less than about 1 micron are particularly preferred for use in the air diffusive portion to prevent penetration of these particles.

Other porous polymeric materials suitable for the diffusive protective layer include but are not limited to films made from other fluoropolymers, polyurethanes, polyesters, polyamides, or copolymers of other suitable polymers having the desired airflow properties. The microporous polymer layer (12) may also be a composite of multiple porous and microporous layers having the desired airflow levels. For example, an expanded PTFE layer can be combined with at least one other porous polymeric film.

The chemical protective material (16) may comprise any material capable of substantially preventing chemical or biological challenges from passing through to the protective enclosure while maintaining adequate air permeation into the enclosure. Materials capable of preventing the ingress of agent challenges have one or more of adsorptive, absorptive, reactive or catalytic properties. A preferred chemical protective material (16) comprises activated carbon. Activated carbon suitable for use in the present invention may be in the form of powders, granules, dried slurries, fibers, spherical beads and the like, and may be combined with one or more other chemical protective materials. Precursors such as coconut husks, wood, pitch, coal rayon, polyacrylonitrile, cellulose and organic resins may be used to form activated carbon suitable for use in the present invention. In one embodiment, the chemical protective material is a textile composite comprising activated carbon beads. Other chemical adsorptive materials can also be used including, but not limited to molecular sieves and inorganic metal oxide particles. In an alternative embodiment, a reactive or catalytic species can be used as the chemical protective material. A reactive or catalytic species can be chosen that is known to effectively react with or cause a reaction of the chemical or biological challenge as it contacts and/or passes through the chemical protective material (16). Because mitigation based on chemical reaction is somewhat selective, one must design this material for the specific threats anticipated. For example, to prevent penetration of hydrochloric acid vapor, a solid base could be used as the chemical protective material (16).

Figure 4:
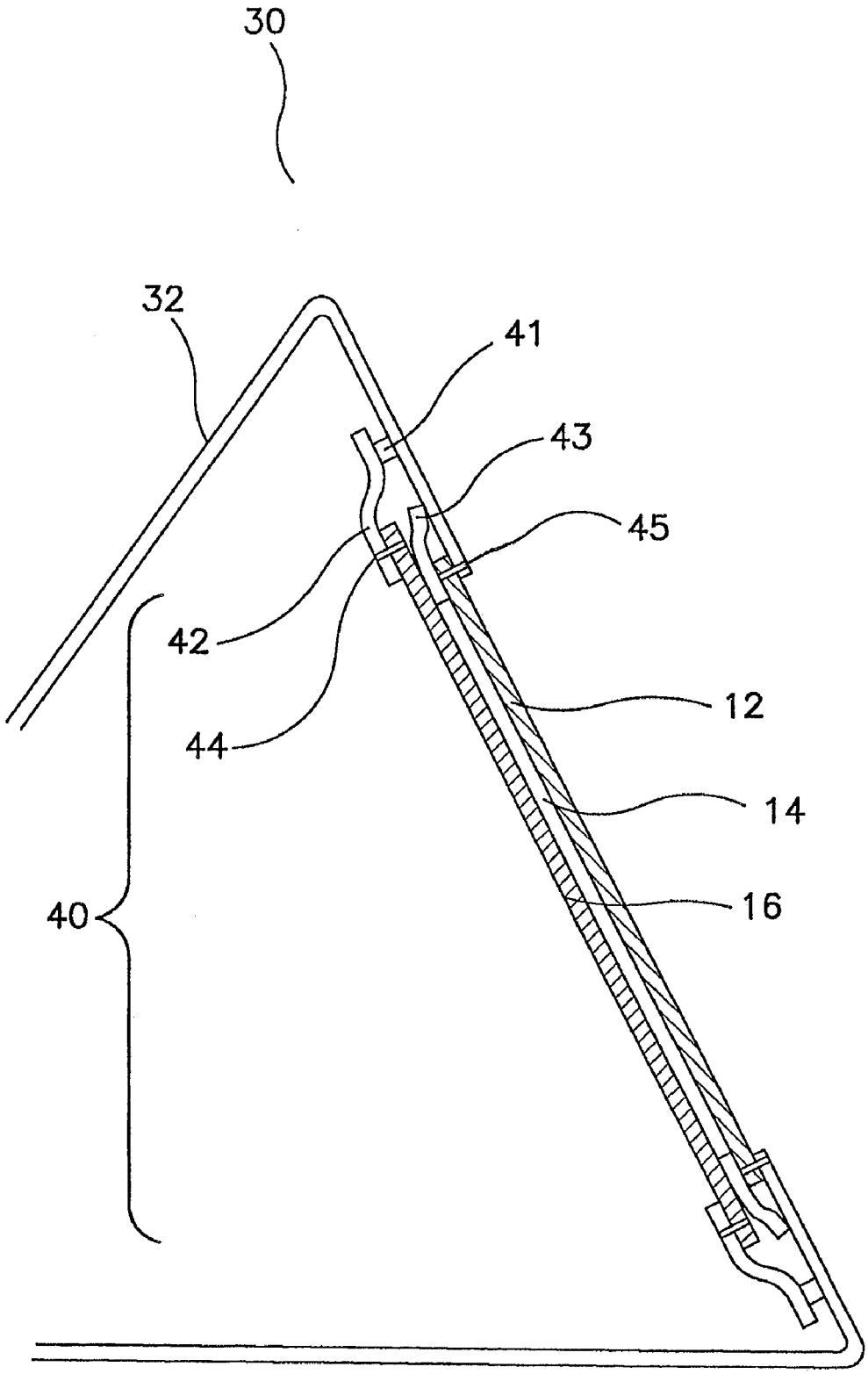
FIG. 4 is a cross-sectional representation of a portion of a chemical protective tent having a replaceable diffusional protective panel.

The chemical protective material may be positioned substantially adjacent the air diffusive portion. Alternately, the chemical protective material may be integrated with an air diffusive portion such as a microporous layer to form a diffusive-protective panel. As illustrated in FIG. 3. to ensure the challenge agent does not diffuse through the microporous polymer layer (12) and around the edges of the chemical protective material (16), the edges of these two materials can be sealed to each other thereby preventing lateral diffusion of the challenge agent along the interfacial region (14) and into the inside of the protective enclosure. Alternately, the perimeter of the chemical protective material (16) can be designed to extend beyond the perimeter of the microporous polymer layer (12) as shown in FIG. 4. Preferred chemical protective portions comprise less than about 400 $g/m^2$ adsorptive material, and most preferably comprise less than about 200 $g/m^2$ adsorptive materials, forming lightweight enclosures.

Additional materials such as textile materials can be combined with the air diffusive portion and/or the chemical protective material to provide protection against physical challenges such as abrasion, scoring, and puncture. Suitable textile materials include knits, non-wovens, wovens, spunbonded materials or any other textile fiber-based material capable of being incorporated into a protective enclosure. In one embodiment, a textile material can be located adjacent to the microporous polymer layer (12). In another embodiment, the textile material may be located adjacent to the chemical protective material (16). And in yet another embodiment, the textile material may be located in the interfacial region (14) between the microporous polymer layer (12) and the chemical protective material (16). Depending on the additional protection required, one or more textile materials may be included at any location within or adjacent to the diffusive protective panel (10). In a preferred protective enclosure, to provide sufficient diffusion of air to sustain a human life while maximizing the chemical protection of the enclosure, it is desired to optimize the outer surface of the enclosure by optimizing the areas of the chemical impermeable section and the air diffusive portion, and also to optimize the amount of chemical protective material, according to the perceived threat. When optimizing the enclosure of the present invention, the following factors may be considered. To sustain the life of a human, the required flux (F) of $O_2$ into a protective enclosure and of $CO_2$ out of the protective enclosure through the air diffusive portion is approximately 0.3 L/min per occupant for a sedentary person. Another parameter to be considered for the protective enclosure of the present invention is the maximum amount by which the $O_2$ pressure within the enclosure may drop ($\Delta p$) while maintaining a life sustaining environment. The relationship between the surface area (A) and the permeability (P) of an air diffusive portion required to provide sufficient flux of air and $CO_2$ to sustain life of a preferred enclosure of the present invention can be represented by Equation 1.

$$(P)(A)=F/\Delta p \qquad \text{Equation 1}$$

where P=permeability ($m^3/m^2$ min bar)

A=surface area of air diffusive portion ($m^3$)

F=flux of $O_2$ or $CO_2$ ($m^3$/min)

$\Delta p$=maximum change in $O_2$ partial pressure (bar)

The level of chemical protection provided by the protective enclosure also depends in part on the area of the air diffusive potion. Equation 2 represents the relationship between a chemical challenge and the area of the air diffusive portion.

$$Ct=0.5(f)(A/V)(t^2) \qquad \text{Equation 2}$$

where Ct=allowable exposure to chemical agent expressed as concentration of the agent times time ($mg/m^3$)

t=exposure time of chemical challenge (min)

f=flux of chemical agent through a unit area of air diffusive portion ($mg/m^2$ min)

A=area of the air diffusive portion ($m^2$)

V=volume of air within the protective enclosure ($m^3$)

This relationship can be useful in the design of a diffusive protective enclosure as described below.

Figure 2:
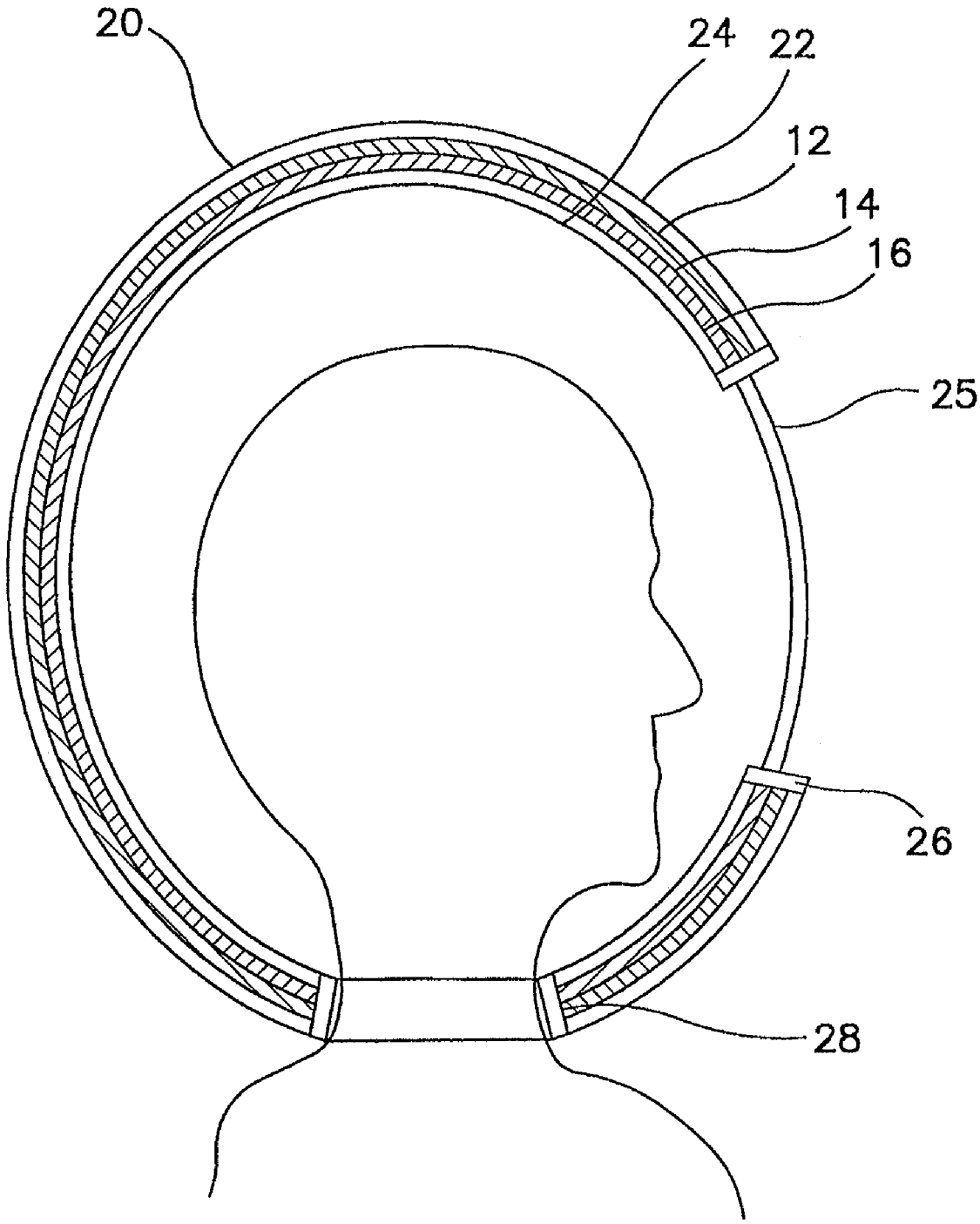
FIG. 2 depicts a cross-sectional representation of a chemical protective enclosure in the form of a hood.

A chemical protective hood (20) depicted in FIG. 2 comprised predominantly of a diffusive protective panel (10) described above and an impermeable barrier section in the form of a viewing window (25) to enable the wearer to see outside the chemical protective hood (20). The impermeable barrier viewing window (25) can be made of any transparent or translucent material that provides protection against chemical or biological challenges. For example, polycarbonate, polyvinylchloride/fluorinated ethylene propylene, and perfluoralkoxy fluorocarbon (PFA) polymers are typically used for transparent and impermeable characteristics. In order to maintain the required level of protection, a seal is maintained between the diffusional protective section and the impermeable viewing window. In one embodiment illustrated in FIG. 2, the impermeable barrier window (25) is sealed against the diffusive protective panel (10) via a sealed interface (26). Likewise, a means is provided to seal the chemical protective hood (20) to either the wearer's chemically or biologically protective suit or against the wearer's neck, for example, via a protective neck dam (28). Suitable neck dam materials can be chosen from but not limited to the following materials; butyl, EPDM, neoprene, natural rubber, or polyurethanes. The thickness of the neck dam (28) material used to seal the protective enclosure can be varied to provide the necessary level of protection. For instance, if the desired polymer has a low permeability to the challenge agent of interest, a thinner layer can be used. Conversely, if the polymer has a slightly higher challenge agent permeability, a thick layer would be required to provide the same level of protection.

The amount of surface area of the air diffusive portion required to provide sufficient oxygen to diffuse into and sufficient CO2 to diffuse out of the protective hood depends on the rate of diffusion of these gases through the given material. For example based on Equation 1, where the permeability of the air diffusive portion is about 0.05 $m^3/(m^2$ min bar) and a decrease in $O_2$ concentration of about 0.05 bar is acceptable, the minimum surface area for the diffusive portion required would be approximately 0.12 $m^2$. The small area required suggests that only a portion of the protective hood would need to comprise the diffusive protective panel to obtain sufficient air permeability to sustain life. However, for reasons such as simplicity or ease of manufacture, it may be desirable to have the majority of the hood produced from the diffusive protective panel materials described above depending upon the anticipated chemical challenge.

When this invention embodies a chemical protective hood, there is often a need for abrasion resistance. For example, enhanced abrasion resistance against external threats can be provided to the microporous polymeric material (12) by adding a first textile material (22). Likewise, the abrasion resistance on the inside of the chemical protective hood (20) can be accomplished by providing a second textile material (24) adjacent to the chemical barrier materials (16) on the inside of the hood.

In one preferred embodiment a chemical protective enclosure is provided comprising an impermeable barrier section and an air diffusive portion wherein the oxygen permeable portion has an airflow preferably greater than about 5 $L/m^2/s$ at 100 Pa, and a permeability to HD agent of less than about 2 $\mu g/cm^2$ per 20 hours at 60 Pa, where the oxygen diffusion into the chemical protective enclosure is sufficient to sustain life, and is preferably greater than 0.3 L/min per occupant. The enclosure further comprises a chemical protective material, preferably an adsorptive material, in an amount of less than about 400 $g/m^2$. Further preferred enclosures have a permeability to HD agent of less than about 1 $\mu g/cm^2$ per 20 hours at 60 Pa. The preferred air diffusive portion is a microporous polymer comprising ePTFE, and the chemical protective material preferably comprises activated carbon, and is removably attached to the enclosure.

Protective enclosures of this invention can be designed to provide sufficient breathable air, i.e., air having a concentration of toxic agent(s) at a level below which serious harm or death to an occupant can occur, to sustain life for a very broad range of times. The duration of chemical protection depends on many factors including the amount of chemical protective material that is used, the concentration of the chemical challenge, and the driving force. A particular chemical protective material or combinations of materials and the material loading is chosen which can adsorb the anticipated chemical or biological challenge for an anticipated duration while allowing for sufficient permeation of oxygen into the enclosure. In the event a person is required to survive within a protective enclosure for a very long time, large amounts of chemical protective material would be required. However the weight and bulk of the required loading of chemical protective material make it impractical to be incorporated from the onset. Therefore, it is desirable to allow an occupant to replace the chemical protective material from within the protective enclosure.

One embodiment of this invention is a chemical protective tent (30) depicted in FIGS. 1 and 4 wherein the chemical protective material (16) is replaceable. In this embodiment, the majority of the chemical protective tent (30) is made with an impermeable barrier section (32), and further comprises a microporous polymer layer (12). In FIG. 4, the replaceable panel of chemical protective material (16) is located adjacent to the microporous polymer layer such that any gas which passes through to the chemical protective material (16) have first passed through the microporous polymer layer (12) before entering the air space within the protective enclosure. Where the panel of chemical protective material (16) is a replaceable panel, a means for attaching the replaceable panel to the protective enclosure is provided. For example, as illustrated in FIG. 4, the panel of chemical protective material (16) is attached to a removable retaining strap (42) by a first sewn attachment (44).

The outer surface of a protective enclosure comprises the impermeable barrier section and, for example, the microporous polymer layer of the air diffusive portion. The two sections may be attached by any means known in the art provided the area of connection of the two sections does not render the outer surface substantially more permeable to water, airflow or chemical/biological challenge than the microporous layer itself. In one embodiment where the chemical protective material is a replaceable panel, the outer surface of the protective enclosure can be made by attaching a microporous polymer layer (12) to the impermeable barrier section (32) by a second sewn attachment (45) as shown in FIG. 4. To ensure the best protection, the second sewn attachment (45) should extend around the perimeter of the air diffusive portion (10), or microporous layer (12) as shown in FIG. 3. After the microporous polymer layer (12) is attached to the impermeable barrier section (32), a seam sealing material (43) can be used to seal the sewn attachment (45) to ensure no hazardous materials penetrate through the sewn seam. Suitable seam sealing materials and methods are known to one skilled in the art. Alternate attachment means known to one skilled in the art may also be used. In some embodiments, it may be desirable to pass items or electrical connections into and out from the protective enclosure. In this case, a section of the diffusive protective panel would be left not sewn.

Once the microporous polymer layer (12) is secured to the impermeable barrier section (32), the replaceable chemical protective material (16) can be attached to the inside of the protective enclosure by first attaching a removable retaining strap (42) to the chemical protective material (16) by a first sewn attachment (44). This construct can then be temporarily secured to the inner surface of the impermeable barrier section (32) by any suitable removable attachment mechanism (41). The specific attachment means for each of these elements can vary depending on the protective enclosure requirements and will be known to a skilled artisan. To insure that all gases diffusive into the chemical protective tent (30) are treated to remove the hazardous agents, it is desirable to design the chemical protective material (16) so that it extends sufficiently beyond the outmost edges of the microporous polymer layer (12).

Figure 5:
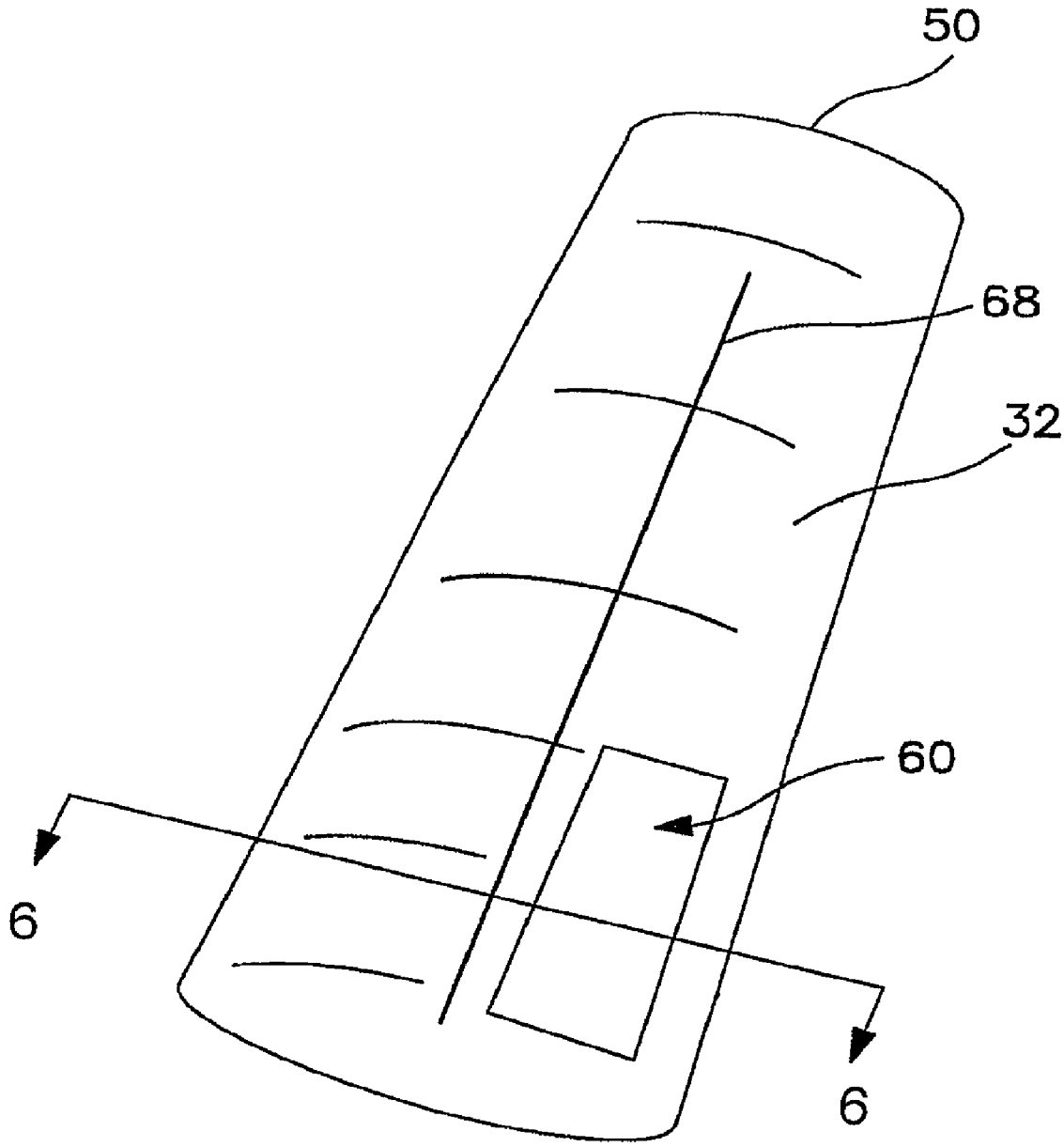
FIG. 5 depicts a chemical protective casualty bag.
Figure 6:
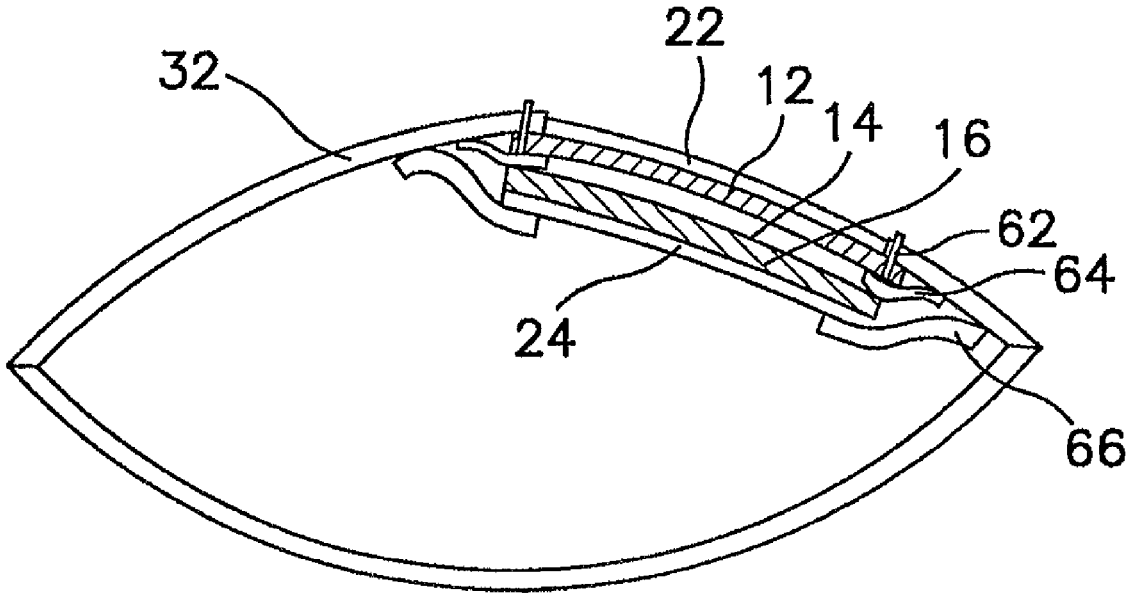
FIG. 6 is a cross-sectional representation of a portion of chemical protective casualty bag.

Another embodiment of this invention is a chemical protective casualty bag (50) depicted in FIGS. 5 and 6. In this form, the patient is fully encapsulated in a protective enclosure comprising an impermeable barrier section (32) and into an air diffusive portion (60) as described above. The fixed air diffusive portion (60) comprises microporous polymer layer (12) over which an optional first textile material (22) is located. This first textile material can be a knit, woven, or non-woven material and may be provided with a chemical treatment for enhanced performance. Some textile treatments that are optionally useful include those which impart improved hydrophobicity, oleophobicity, or chemical repellency. The specification of any of the optional textile layers or textile treatments of this invention are known to one skilled in the art.

To improve handling or protective enclosure construction, the microporous polymer layer (12) can optionally be adhered to the first textile material (22). Any suitable adherence means can be used such as but not limited to lamination, thermal bonding, fusion bonding, ultrasonic welding, or RF welding. FIG. 6, represents cross-section 6-6 of the casualty bag of FIG. 5, and depicts the first textile material (22) adhered to the microporous polymer layer (12) in the form of a laminate. This laminate is attached to the impermeable barrier section (32) by a third sewn seam attachment (62). This third sewn seam attachment (62) is then sealed by a second sealing material (64). Suitable sealing materials include but are not limited to polyurethane polymers, neoprene, EPDM, thermoplastic fluoropolymers, and thermoplastic polyolefins. In this embodiment, the chemical protective material (16) is provided as a laminate with a second textile layer (24). These laminated layers are then attached to the impermeable barrier section (32) by either a removable attachment means as described previously with respect to FIG. 4 or by a fixed attachment means (66). Suitable attachment means (66) include but are not limited to retaining straps, adhesive beads, tapes and the like known to one skilled in the art. The chemical protective casualty bag (50) may include a chemical protective casualty bag closure (68) to facilitate entry to and exit from the protective enclosure.

Test Methods

Air permeability—The air permeability of test specimens was measured using the ISO standard test method described in ISO 9237 "Textile Determination of Permeability of Fabrics to Air" with the following modifications. Because on thicker sample the challenge air can escape laterally from the cut sides of the test specimen and therefore produce erroneous data, air impermeable tape was used to seal the edges of the test specimen. The gasket on the test apparatus then could seal against this tape and thereby force all of the air to pass through the test specimen to the air flow detector. The test area was 20.27 $cm^2$ and the airflow rate reported in $L/m^2/sec$ at 100 Pa.

Oxygen permeability—Test samples were prepared by first cutting out circular samples of material layers to be tested, 11.2 cm diameter, using a suitable die. In these tests, samples were sealed between two chambers. The first chamber is challenged with a fixed concentration of oxygen; the second chamber is filled with nitrogen. During the test, an oxygen sensor is used to measure the concentration rise in the second chamber as a function of time. The value reported is the oxygen permeability reported in $m^3/m^2$-hr-bar.

The test equipment was comprised of a test cell equipped with oxygen sensors. Oxygen sensor having a range of 0-100%, Type FY 9600-O2, were obtained from Ahlbom Mess und Regelungstechnik GmbH in Holzkirchen, Germany. The test cell was cylindrical in shape and sealed at all ports to prevent any significant oxygen ingress. The test cell was equipped with circulating fan to maintain a well-mixed environment within the cell. A nitrogen supply was fed into the test cell. The testing procedure involved connecting the oxygen sensor from within the cells to a data recording unit, then connecting nitrogen supply line to measuring cells, switching on ventilators in measuring cells, calibrating the oxygen sensors at 12.8-13.0 mV (≅20.9% oxygen), and placing test samples over measuring cells. Sample measurements were performed while the samples were dry. The data recording unit had a sampling rate of one data point every 3 seconds. After 10 seconds, the nitrogen supply line was opened to fill measuring cells until all oxygen sensors have dropped below 3.0 mV (≅5% oxygen). The nitrogen supply line was then closed. Data collection was allowed to continue until all sensors were above 10.0 mV (≅15% oxygen); then the recording was stopped. Evaluation of the results within the range of 5%-15% oxygen involved reading the data of each individual measuring cell from the data recording unit into the calculation program, and determining the average value of the three individual results along the fabric width. The calculations were based on the time required by one test sample in order to adjust the oxygen content of the measuring cell from 5% to 15% oxygen. The permeation P determined by this method was in units of $m^3/m^2h$ bar. In order to ensure adequate permeation, the permeation rate P as measured should be ≧6 $m^3/m^2h$ bar.

Convective Flow Penetration Test—The chemical permeability of diffusive test specimens was measured using standard 'dual flow' configuration according to TOP 8-2-501, and "Laboratory Methods for Evaluating Protective Clothing Systems Against Chemical Agents" CRDC-SP-84010 (June 1984).

Diffusive Penetration Test—The chemical permeability of air permeable test specimens was measured in a convective mode using standard test method TOP 8-2-501, but with the following modifications. Chemical analysis was performed consistent with TOP 8-2-501 and CRDC-SP-84010 (June 1984). The airflows used above and below the sample were 250 $cm^3$/min and 300 $cm^3$/min respectively. The air streams were maintained at 32±1.1° C. and the relative humidity was controlled at 80±8%. For liquid challenges, the droplets were placed on the face-textile surface of a horizontally oriented test specimen. For chemical vapor challenges, the challenge was applied to the face-textile side of the specimen and maintained for the duration of the test period.

Waterproof Test—Waterproof testing was conducted as follows. Fabric constructions were tested for waterproofness by using a modified Suter test apparatus, which is a low water entry pressure challenge. Water is forced against a sample area of about 4¼ inch diameter sealed by two rubber gaskets in a clamped arrangement. The sample is open to atmospheric conditions and is visible to the operator. The water pressure on the sample is increased to about 1 psi by a pump connected to a water reservoir, as indicated by an appropriate gauge and regulated by an in-line valve. The test sample is at an angle and the water is recirculated to assure water contact and not air against the sample's lower surface. The upper surface of the sample is visually observed for a period of 3 minutes for the appearance of any water which would be forced through the sample. Liquid water seen on the surface is interpreted as a leak. A passing (waterproof) grade is given for no liquid water visible within 3 minutes. Passing this test is the definition of "waterproof" as used herein.

EXAMPLES

While particular embodiments of the present invention have been illustrated and described herein, the present invention should not be limited to such illustrations and descriptions. It should be apparent that changes and modifications may be incorporated and embodied as part of the present invention within the scope of the following claims.

Example 1

A preferred embodiment comprising the diffusive protective panel of the present invention was constructed comprising an air diffusive portion and a chemical protective material. Experiments were conducted to determine the number of layers and the weight of carbon required to provide a desired level of protection from permeation of chemical agents through the material. The chemical protective material (16) samples of this example were prepared based on activated carbon. A swatch of material containing activated carbon beads was cut from the liner of a Saratoga® suit (Texplorer® GmbH, Nettetal, Germany). The approximate areal density of carbon in the liner according to the literature was 180 $g/m^2$. In an attempt to independently confirm this areal density, the liner was carefully deconstructed, and the beads mechanically removed. The measured carbon areal density was about 180-200 $g/m^2$. Samples of carbon hereafter referred to as 'carbon layer A', were cut from the liner material of the Saratoga® suit. Next, a piece of a garment shell (a 204 $g/m^2$, water repellent treated, woodland camouflage printed nylon/cotton blend) taken from the Saratoga® suit for use as a shell material in this example. This nylon/cotton shell will hereafter be referred to as 'face textile A.'Face textile A was then placed over carbon layer A and swatch tests conducted in accordance with the test methods above. This construction was used as a reference sample to show results in the absence of the air diffusive material of this invention.

One critical component of the diffusive protective panel of this chemically protective enclosure invention is the air diffusive portion, which preferably comprises a microporous polymer layer. Textiles were adhered to both side of the microporous polymer layer. The resulting construction, hereafter referred to as a three-layer laminate, was prepared as follows. An expanded oleophobic PTFE membrane having the desired airflow characteristics and weighing about 20 $g/m^2$ was prepared substantially in accordance with U.S. Pat. No. 6,074,738. A woven face textile weighing about 54 $g/m^2$ was constructed based on false twist textured 40/34 yarns. The second textile material was a 51 $g/m^2$ nylon tricot knit. The three layer laminate was created by gravure printing a discrete dot pattern of a moisture curing polyurethane adhesive onto the membrane and subsequently nipping the woven to one side and the knit to the other side of the membrane as described in U.S. Pat. No. 5,981,019. Subsequent to lamination, the woven side of the three layer package was coated with a fluoroacrylate based water repellent treatment, in a manner similar to those known to the skilled artisan. Samples cut from this three layer microporous expanded PTFE laminate will hereafter be referred to as 'face textile B.'

Stacked constructions of these samples were then tested for chemical permeation at Geomet Technologies, LLC, using liquid chemical challenges of Sulfur Mustard (HD), Soman (GD) and thickened Soman (tGD) according to the "U.S. Army Test and Evaluation Command: Test Operations Procedure 8-2-501" (TOP 8-2-501). The testing was performed using a challenge level of 10 $mg/m^2$ (ten one μl drops over a 10 $cm^2$ area), with flow rates of 0.3 L/min on each side at the pressures indicated (pressure applied to challenge side). For low air flow constructions (employing a microporous polymer layer, face textile B) the tests were run using the Diffusive Penetration Test configuration according to TOP 8-2-501. High air flow construction samples comprising 'face textile A', were tested using the Convective FlowPenetration Test procedure according to TOP 8-2-501. The sampling intervals for measuring breakthrough were 0-2 hours, 2-6 hours, 6-12 hours, 12-20 hours. The results are shown in Table 1 for Sample ID numbers 1-8 and 12-15 which comprised face textile 'B', and comparative samples 9-11, which comprised face textile 'A'.

It is important to note that each of these tests was run with multiple layers stacked on top of one another. In addition, the 'textile' layer is always used as the outermost layer to face the chemical warfare agent challenge. For instance, in the Table 1 samples with three layers of 'carbon layer A' and one layer of 'face textile B' the 'face textile B' was placed on top of the three carbon layers with the woven shell oriented upward.

This stack was then placed in the text fixture sealed and challenged with agent on the surface of the woven. The detection limit for the equipment was 0.000046 μg/cm$^2$ for GD and 0.1 μg/cm$^2$ for HD. To assess the ability of the samples to protect against chemical warfare agent in a wind driven environment, an overpressure was applied to the agent challenge side of the samples as indicated in Table 1.

TABLE 1

| Sample No. | Face Textile | Carbon Layer | No. of Carbon LayersAgent | | Pressure | Breakthrough In μg/cm$^2$ 0-2 hrs | 2-6 hrs | 6-12 hrs | Cumulative Breakthrough (μg/cm$^2$ 20 hours) |
|---|---|---|---|---|---|---|---|---|---|
| 1 | B | A | 1 | HD | 0 | 0.1 | 0.1 | 0.1 | 0.4 |
| 2 | B | A | 1 | HD | 0 | ND | 0.1 | 0.1 | 0.3 |
| 3 | B | A | 1 | HD | 62Pa | 0.2 | 0.6 | 0.2 | 1.1 |
| 4 | B | A | 1 | HD | 62Pa | 0.2 | 0.4 | 0.2 | 0.9 |
| 5 | B | A | 3 | HD | 0 | ND | ND | ND | ND |
| 6 | B | A | 3 | HD | 0 | ND | ND | ND | ND |
| 7 | B | A | 3 | HD | 62Pa | ND | 0.1 | ND | 0.1 |
| 8 | B | A | 3 | HD | 62Pa | ND | ND | ND | ND |
| 9 | A | A | 1 | GD | 25 Pa* | 25.4958 | 9.4278 | | 40.371* |
| 10 | A | A | 1 | GD | 25 Pa* | 18.6378 | 13.5567 | | 41.939* |
| 11 | A | A | 1 | GD | 25 Pa* | 8.999 | 0.782 | | 12.326* |
| 12 | B | A | I | tGD | 62 Pa | 0.0034 | 0.0054 | 0.0013 | 0.01130 |
| 13 | B | A | 1 | tGD | 62 Pa | 0.0026 | 0.0027 | 0.0012 | 0.0072 |
| 14 | B | A | 3 | tGD | 62 Pa | ND | 0.0008 | 0.0001 | 0.0003 |
| 15 | B | A | 3 | tGD | 62 Pa | ND | ND | 0.0028 | 0.0038 |

*These samples were tested using the convective flow test configuration under TOP 8-2-501 since these samples did not contain amicroporous polymer layer and therefore had high air flow. Cumulative breakthrough measurements for theseconvective flow samples were collected over a 24 hour period instead of 20 hours.

The data in Table 1 for Samples 1 through 8 indicate that the overpressure (62 Pa) had little influence on the HD agent permeation results, all of which were tested with 'face textile B' containing a microporous polymer layer (12) adjacent to the chemically protective material (16). The results of Samples 12 through 15 indicate low permeation results for tGD, where all of the samples used face textile "B" comprising a microporous polymer layer (12). In contrast, when samples using face textile "A" having no microporous polymer layer, were tested under convective flow, the cumulative breakthrough is much higher. Samples 9 through 11 indicate high concentrations of GD permeated through the test specimens within a couple hours.

For percutaneous chemical warfare agent threats, the US military has established several target performance values ("TPVs") for various agents. Most notably, for the current protective infantry suit materials used in the Saratoga® suit, the TPVs for unworn material are 671 μg-minute/liter-10 cm$^2$-day for HD and 357 μg-minute/liter-10 cm$^2$-day for GD (as described in, for example, US Military "Alternate Footwear Solution" specification M6700404R002404-R-0024-0002.zip, "Table 1: Requirements Verification Matrix" section 3.3.1.1). The TPV values are obtained by dividing the cumulative breakthrough by the airflow. The material used in the Saratoga® suit has an average airflow of 0.3 L/minute, and therefore would have a targeted cumulative breakthroughs ("TCBs") of about 20.1 μg/cm$^2$-day for HD and 10.71 μg/cm$^2$-day for GD. For comparitive purposes, it is important to note that tGD is a thickened version of GD designed to remain on the test specimen longer without evaporating. The data in Table 1 indicate desired levels of protection against permeation of HD and tGD are achieved for Samples 1-8 and 11 through 15. Permeation rates are well below the threshold values for embodiments of the present invention comprising a microporous polymer layer and using either one or three layers of the activated carbon chemical protective material (16).

Oxygen permeability requirements for protective enclosures of the present invention were also calculated. In addition to providing protection from the permeation of toxic chemicals, there needs to be sufficient $O_2$ permeability through the diffusive protective panel to sustain life in the absence of an auxiliary air source. Testing for oxygen permeability was accomplished using constructions similar to those used in the chemical agent testing above, except the test samples were subject to $O_2$ permeation testing as described in the above test methods. The oxygen permeability results were reported in m$^3$/m$^2$-hr-bar. The higher the value for oxygen permeability, the smaller the area required to sustain an individual within the protective enclosure for about six to eight hours. Using the $O_2$ permeation rates shown in Table 2, the steady state diffusive flux of oxygen through a material or series of materials can be described by the following equation:

$$\phi = P*A*\Delta p$$

where P is the permeability of the material, A is the area, and Δp is the partial pressure gradient across the material or system of materials (and * indicates a product).

For demonstrative purposes, Δp is estimated at about 0.05 bar where ambient air contains about 21% oxygen and about 16% oxygen is sufficient for human survival. In addition, a reasonable sedentary breathing rate of 15 breaths/minute at an exhalation capacity of about 0.5 L/breath is assumed. Based on these assumptions, the approximate area of oxygen permeable material required to sustain human life is given by:

$$A = \phi/(P*\Delta p)$$

$$A = (7.5\ \text{L/minute}*4\%\ \text{oxygen consumption})/P(5\%\ \text{oxygen gradient})$$

To convert this to units comparable to those measured this results in:

$$A = (0.018\ \text{m}^3/\text{hr})/(P*(0.05\ \text{bar}))$$

Where samples have an oxygen permeability of 3.4 m$^3$/m$^2$-hr-bar (as shown below), it is calculated that an area of about 0.11 square meters of oxygen permeable material is needed to sustain human life. Table 2 shows the measured oxygen permeability for diffusive protective panels of this example described above. Clearly, a diffusive protective panel of this invention having greater than 0.11 $m^2$ surface area provides adequate oxygen permeability to sustain life within a protective enclosure, whether it be a patient bag, hood, or tent type enclosure.

TABLE 2

| FACE TEXTILE | Carbon Layer | No. of Carbon Layers | $0_2$ Permeability ($m^3/m^2$*hr*bar) | Minimum Area of $0_2$ Permeable Section ($m^2$) |
|---|---|---|---|---|
| B | A | 1 | 5.3 | 0.07 |
| B | A | 3 | 3.4 | 0.11 |

While the minimum area of the diffusive protective panel (10) are calculated, even in a scenario where the driving force for oxygen diffusion is reduced, this invention still provides life sustaining oxygen. To provide a margin of safety, a diffusive protective panel (10) area greater than 0.2 $m^2$ is preferred. However, because the area available to penetrating chemical challenges increases with increasing diffusive protective panel (10) area, analyses were performed assuming a 1 $m^2$ diffusive protective panel area in a hypothetical protective enclosure described in Example 2 below.

Example 2

In this example, the constructions of Example 1 were tested against HD and Sarin (GB) chemical warfare agents. Vapor challenges at 40 mg/$m^3$ and 1000 mg/$m^3$, respectively, held continuously, were tested using swatch testing in a dual flow configuration according to TOP 8-2-501, as described previously. Constructions consisting of either one or three layers of 'carbon layer A' in combination with 'face textile B' were subjected to the HD or GB vapor challenge. The data from these tests were then used to determine the total cumulative breakthrough measured in μg/$cm^2$ at 20 hours as shown in Table 3.

The time required for a person to have a 50 percent chance of either death (LCt50) or permanent damage (ECt50), was calculated from the total cumulative breakthrough values in Table 3. An explanation of these calculations is given in "Review of Acute Human Toxicity Estimates for Selected Chemical Warfare Agents."

To convert the breakthrough values to a concentration*time value (Ct) for comparison with the toxicity information, the breakthrough (mass flux) values were first converted to a concentration change per time interval, inside a hypothetical enclosure. The concentration equals the total breakthrough up to the 20 hour time interval specified multiplied by the surface area of the diffusive protective panel divided by the enclosure free volume.

To demonstrate the level of inhalation protection achieved by a protective enclosure embodiment of this invention, calculates were based on an enclosure volume of 20 liters and a diffusive protective panel area of one square meter. Using these protective enclosure design parameters, the concentration was plotted as a function of time. The slope of the curve was determined by linear regression. The value of concentration*time for a specific enclosure design at a specific exposure duration equals the area under this concentration versus time graph up to the exposure time of interest. This value was therefore calculated by integrating the slope with respect to time twice to obtain the equation $Ct=0.5*slope*t^2$ in units of mg-min/$m^3$. The times required to achieve the LCt50 and ECt50 were calculated by substituting the LCt50 or ECt50 into this equation and solving for the allowable exposure time, as shown in Table 4.

Table 5 was constructed to demonstrate the inhalation protection of constructions under this invention, when subjected to a liquid (tGD) challenge. In this case, the data shown in Table 1 were similarly analyzed in a hypothetical enclosure of volume 20 L and diffusive protective panel (10) area of one square meter. The concentration increase curves were constructed, the linear slopes obtained and subsequently the expected time to reach ECt50 and LCt50 were derived. As shown previously in Table 4, the various embodiments of this invention all provided hours of protection against GD and tGD challenges.

TABLE 3

| # Carbon Layers | Agent | Challenge | Pressure | Breakthrough in micrograms/cm2 0-1 hrs | 1-2 hrs | 2-6 hrs | total cumulative (20 hrs) |
|---|---|---|---|---|---|---|---|
| 1 | HD Vapor | 40 mg/m3 (held continuously) | 62 Pa | ND | ND | 0.1 | 1.1 |
| 1 | HD Vapor | 40 mg/m3 (held continuously) | 62 Pa | ND | ND | 0.1 | 1.2 |
| 3 | HD Vapor | 40 mg/m3 (held continuously) | 62 Pa | ND | ND | ND | 0.1 |
| 3 | HD Vapor | 40 mg/m3 (held continuously) | 62 Pa | ND | ND | ND | 0.1 |
| 1 | GB Vapor | 1000 mg/m3 (held continuously) | 62 Pa | 0.147 | 0.46 | 6.961 | 220.4 |
| 1 | GB Vapor | 1000 mg/m3 (held continuously) | 62 Pa | 0.157 | 0.365 | 7.402 | 270.5 |
| 3 | GB Vapor | 1000 mg/m3 (held continuously) | 62 Pa | 0.0095 | 0.012 | 0.56 | 7.7 |
| 3 | GB Vapor | 1000 mg/m3 (held continuously) | 62 Pa | ND | ND | 0.00043 | 0.23 |

TABLE 4

Estimated Time to Inhalation Threat for Vapor HD and GB on Protective Enclosure Diffusive Filter Element Constructions (from Table 3)

| Average of Samples | No. of Carbon Layers | Agent | Challenge | Pressure | Slope | LCt50 (mg-min/m$^3$) | Calc. Time to LCt50(hrs) | ECt50 (mg-min/m$^3$) | Calc. Time to ECt50 (hrs) |
|---|---|---|---|---|---|---|---|---|---|
| 16 and 17 | 1 | HD Vapor | 40 mg/m$^3$ | 62Pa | 5.0E-4 | 1500 | 41 | 200 | 15 |
| 18 and 19 | 3 | HD Vapor | 40 mg/m$^3$ | 62Pa | 4.0E-5 | 1500 | 144 | 200 | 53 |
| 20 and 21 | 1 | CB Vapor | 1000 mg/m$^3$ | 62Pa | 4.7E-2 | 70 | 0.9 | 35 | 0.6 |
| 22 and 23 | 3 | CD Vapor | 1000 mg/m$^3$ | 62Pa | 2.2E-3 | 70 | 4.2 | 35 | 3.0 |

Table 5 Estimated Time to Inhalation Threat for Liquid GD on Protective Enclosure Diffusive Filter Element Constructions (from Table 1)

TABLE 5

| Average of Samples | Agent | Slope | LCt50 (mg-min/m$^3$) | Calculated time to LCt50 (hrs) | ECt50 (mg-min/m$^3$) | Slope | Calculated time to ECt50 (hrs) |
|---|---|---|---|---|---|---|---|
| 9-11 | GD | 0.0045 | 70 | 2.93 | 35 | 0.0045 | 2.08 |
| 12-13 | tGD | 2E-6 | 70 | 139.4 | 35 | 2E-6 | 98.6 |
| 14-15 | tGD | 1E-6 | 70 | 197.2 | 35 | 1E-6 | 139.4 |

From Tables 3 through 5, the current invention can be seen to provide more than adequate protection against HD vapor challenges. Even with just one layer of carbon layer "A" in combination with the $O_2$ permeable laminate would provide enough vapor protection (LCt50) for over 40 hours. And in the embodiment using three layers of carbon layer "A" in conjunction with the $O_2$ permeable laminate, 200 hours of HD vapor protection are expected. Likewise, even when challenged with a very high concentration of GB, the expected protection time is still 54 minutes with one layer of carbon in combination with the $O_2$ permeable laminate and over four hours when three layers of carbon are used in combination with the same $O_2$ permeable laminate.

Example 3

The liquid-proof characteristic of this invention was determined using the Suter test method described above. Because the chemical protective material of each embodiment was not expected to be waterproof, the suter testing was conducted on the face textiles "A" and "B" described above. Embodiments constructed with face textile B all did not leak after 3 minutes at 1 psi water pressure. In contrast, all embodiments constructed with face textile A leaked as soon as the water pressure began to register on the pressure gauge.

Example 4

The unique air flow characteristic of the air diffusive portion of this invention were determined using the air permeability test method described previously. Test specimens were constructed from both face textiles "A" and "B" in combination with both one and three layers of carbon material "B". The airflow results as a function of pressure are given in Table 6.

TABLE 6

Air Permeability Results

| Face Textile | No. of Carbon Layers B | Pressure (psig) | Airflow (L/m$^2$/sec) |
|---|---|---|---|
| B | 1 | 50 | 0.056 |
| B | 1 | 100 | 0.692 |
| B | 1 | 200 | 1.36 |
| B | 1 | 500 | 3.19 |
| B | 3 | 50 | 0.612 |
| B | 3 | 100 | 1.23 |
| B | 3 | 200 | 2.27 |
| B | 3 | 500 | 4.94 |
| A | 1 | 50 | 7.77 |
| A | 1 | 100 | 15.3 |
| A | 1 | 200 | 30.0 |
| A | 1 | 500 | 69.7 |
| A | 3 | 50 | 3.16 |
| A | 3 | 100 | 6.09 |
| A | 3 | 200 | 11.8 |
| A | 3 | 500 | 27.7 |

The data of Table 6 indicate that at over a range of pressure, that face textile B containing the microporous polymer layer provided significantly lower airflow rates. For purposes of the present invention, bulk airflow rates less than or equal to about 5 L/m$^2$/sec at 100 Pa are considered as diffusive airflow, and therefore for purposes of the present invention diffusive materials are materials which have an airflow therethrough at less than or equal to about 5 L/m$^2$/sec at 100 Pa. Bulk airflow above this rate is considered as convective. As previously discussed, the diffusional flow provided by the air diffusive portion, which is preferably a microporous polymer layer, limits the challenges to diffusional mechanism whereby the abatement can be provided with a relatively thin chemical protective material.

The present invention uniquely provides a protective enclosure that is liquid-proof, has sufficient oxygen and $CO_2$ diffusion to sustain life while concurrently providing chemical protection. Moreover, the characteristics of the diffusive protective panel of this invention are such to provide for safe inhalation even in environments where both vapor and liquid chemical challenges and wind-driven assaults are expected.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A chemical protective enclosure comprising a) a waterproof outer surface comprising i. an impermeable barrier portion that is impermeable to gas and liquids, and ii. an air diffusive portion having an airflow of less than about 5 $L/m^2/s$ at 100 Pascals and b) a chemical protective material adjacent the air diffusive portion, wherein the chemical protective enclosure comprises greater than about 0.3 L/min/occupant oxygen diffusion through the air diffusive portion.

2. The chemical protective enclosure of claim 1 wherein the air diffusive portion comprises a microporous polymer layer.

3. The chemical protective enclosure of claim 1 wherein the air diffusive portion has an airflow of less than about 3 $L/m^2$ s at 100 Pascals.

4. The chemical protective enclosure of claim 1 wherein the air diffusive portion has an airflow of less than about 2 $L/m^2/s$ at 100 Pascals.

5. The chemical protective enclosure of claim 1 having a cumulative breakthrough of sulfur mustard (HD) through the air diffusive portion and the chemical protective material at 20 hours that is less than or equal to about 2 $\mu g/cm^2$ at an exposure pressure of about 60 Pa.

6. The chemical protective enclosure of claim 1 having a cumulative breakthrough of sulfur mustard (HD) through the air diffusive portion and the chemical protective material at 20 hours that is less than or equal to about 1 $\mu g/cm^2$ at an exposure pressure of about 60 Pa.

7. The chemical protective enclosure of claim 1 wherein the air diffusive portion comprises a porous fluoropolymer.

8. The chemical protective enclosure of claim 1 wherein the air diffusive portion comprises porous polytetrafluoroethylene.

9. The chemical protective enclosure of claim 1 wherein the air diffusive portion comprises expanded porous polytetrafluoroethylene.

10. The chemical protective enclosure of claim 1 wherein the chemical protective material is removable.

11. The chemical protective enclosure of claim 10 wherein the chemical protective material comprises a detachment mechanism for removing and replacing the chemical protective material.

12. The chemical protective enclosure of claim 1 wherein the chemical protective material is adsorptive.

13. The chemical protective enclosure of claim 1 wherein the chemical protective material comprises activated carbon.

14. The chemical protective enclosure of claim 1 wherein the air diffusive portion and the chemical protective material are integrated to form a diffusive protective panel.

15. The chemical protective enclosure of claim 14 wherein the diffusive protective panel has a thickness of less than about 15 mm.

16. The chemical protective enclosure of claim 14 wherein the diffusive protective panel comprises a microporous polymer layer and an adsorptive material.

17. The chemical protective enclosure of claim 14 wherein the diffusive protective panel comprises a porous expanded polytetrafluoroethylene membrane and activated carbon.

18. The chemical protective enclosure of claim 14 wherein the chemical protective material comprises less than 200 $g/m^2$ of adsorptive material.

19. The chemical protective enclosure of claim 14 wherein the diffusive protective panel further comprises at least one textile layer.

20. The chemical protective enclosure of claim 14 where in the diffusive protective panel has a permeability to oxygen greater than about 3 $m^3/m^2$*hr*bar, an airflow of less than about 5 $L/m^2/s$ at 100 Pascals, and having a cumulative breakthrough of sulfur mustard (HD) through the diffusive protective panel at 20 hours that is less than or equal to about 2 $\mu g/cm^2$ at an exposure pressure of about 60 Pa.

21. The chemical protective enclosure of claim 20 wherein the diffusive protective panel has a thickness of less than about 15 mm.

22. The chemical protective enclosure of claim 1 wherein the chemical protective material comprises less than 400 $g/m^2$ of adsorptive material.

23. The chemical protective enclosure of claim 1 wherein the impermeable barrier portion comprises a fluoropolymer.

24. The chemical protective enclosure of claim 1 wherein the impermeable barrier portion further comprises a textile.

25. The chemical protective enclosure of claim 1 wherein the air diffusive portion is liquid-proof.

26. The chemical protective enclosure of claim 1 wherein the air diffusive portion further comprises at least one textile layer.

27. The chemical protective enclosure of claim 1 wherein the enclosure comprises a tent.

28. The chemical protective enclosure of claim 1 wherein the enclosure comprises a casualty bag.

29. The chemical protective enclosure of claim 1 wherein the enclosure comprises a hood.

30. The chemical protective enclosure of claim 29 wherein the hood comprises a protective barrier viewing window.

31. A chemical protective enclosure comprising a) a waterproof outer surface comprising i. an impermeable barrier portion that is impermeable to gas and liquids and ii. an air diffusive portion comprising a microporous porous polytetrafluoroethylene layer, the air diffusive portion having an airflow of less than about 5 $L/m^2/s$ at 100 Pascals, and b) a chemical protective material comprising activated carbon positioned adjacent the microporous porous polytetrafluoroethylene layer and opposite the outer surface, wherein air diffusing through the microporous porous polytetrafluoroethylene layer passes through the chemical protective material before entering the chemical protective enclosure, and wherein greater than about 0.3 L/min/occupant oxygen diffuses through the air diffusive portion and into the chemical protective enclosure.

* * * * *

UNITED STATES PATENT AND TRADEMARK OFFICE

CERTIFICATE OF CORRECTION

PATENT NO. : 7,549,431 B1
APPLICATION NO. : 10/985420
DATED : June 23, 2009
INVENTOR(S) : Farnworth et al.

It is certified that error appears in the above-identified patent and that said Letters Patent is hereby corrected as shown below:

In Claim 3 lines 24-25: change "3 L/$m^2$ s" to --3 L/$m^2$/s--

Signed and Sealed this

Eighth Day of September, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,549,431 B1
APPLICATION NO. : 10/985420
DATED : June 23, 2009
INVENTOR(S) : Farnworth et al.

It is certified that error appears in the above-identified patent and that said Letters Patent is hereby corrected as shown below:

Column 19, In Claim 3, lines 24-25: change "3 L/$m^2$ s" to --3 L/$m^2$/s--

This certificate supersedes the Certificate of Correction issued September 8, 2009.

Signed and Sealed this

Twenty-ninth Day of September, 2009

David J. Kappos

David J. Kappos
*Director of the United States Patent and Trademark Office*